United States Patent [19]

Skinner et al.

[11] 4,413,780

[45] Nov. 8, 1983

[54] FUEL INJECTION NOZZLES

[75] Inventors: Robert T. J. Skinner, High Wycombe; John W. Clegg, North Harrow, both of England

[73] Assignee: Lucas Industries Limited, Birmingham, England

[21] Appl. No.: 308,597

[22] Filed: Oct. 5, 1981

[30] Foreign Application Priority Data

Nov. 19, 1980 [GB] United Kingdom ..... 8037091

[51] Int. Cl.[3] ..... F02M 61/08

[52] U.S. Cl. ..... 239/533.4; 239/533.12

[58] Field of Search ..... 239/533.2–533.12, 239/584

[56] References Cited

U.S. PATENT DOCUMENTS

| | | | |
|---|---|---|---|
| 1,156,846 | 10/1915 | Johnson | 239/533.5 X |
| 2,235,365 | 3/1941 | Grumbt | 239/584 X |
| 2,392,474 | 1/1946 | Haines . | |

FOREIGN PATENT DOCUMENTS

| | | | |
|---|---|---|---|
| 742780 | 12/1943 | Fed. Rep. of Germany . | |
| 831470 | 2/1952 | Fed. Rep. of Germany . | |
| 862976 | 1/1953 | Fed. Rep. of Germany | 239/533.4 |
| 1035267 | 8/1953 | France | 239/533.3 |
| 531349 | 1/1941 | United Kingdom | 239/533.11 |
| 693312 | 6/1953 | United Kingdom | 239/584 |

*Primary Examiner*—Andres Kashnikow

[57] ABSTRACT

A fuel injection nozzle includes a body defining a bore to which fuel can be supplied. The bore defines a guide portion of reduced diameter at its outer end and the guide portion supports a valve member for axial movement. The valve member has an outlet orifice formed therein. The orifice in the closed position of the valve member is closed by the guide portion and is uncovered to the bore to allow fuel flow as the valve member is moved by fuel under pressure.

10 Claims, 8 Drawing Figures

FUEL INJECTION NOZZLES

Figure 1:
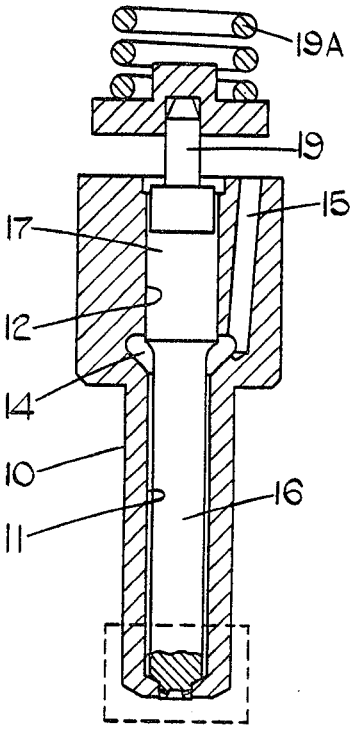

This invention relates to fuel injection nozzles for use with internal combustion engines and of the kind comprising a body having a fuel inlet which in use is connected to a high pressure source of fuel, a resiliently loaded valve member slidable within the body, said valve member defining a surface against which the fuel under pressure can act to lift the valve member to an open position against the resilient loading thereby to allow flow of fuel to an outlet orifice.

Nozzles of the aforesaid type are well known in the art. The most common form of nozzle includes a body in which is formed a blind bore defining the seating. The valve member is slidable within the bore and is shaped to co-operate with the seating to prevent fuel flow beyond the seating and through the outlet orifice. Such nozzles have in the past been provided with a small chamber known in the art as the "sac". The chamber is located downstream of the seating and although of smaller diameter than the bore, can be regarded as being the blind end of the bore. The orifice is formed in the wall of the chamber. It is well known that the volume of the chamber should be kept as low as possible in order to minimise the volume of fuel which leaks through the orifice after the valve member has moved onto its seating. It is not possible to eliminate the chamber entirely and in order to prevent fuel flow after closure of the valve member, it has been proposed to position the orifice so that it extends from the seating and is therefore covered by the valve member when the latter is in the closed position. Thus when the valve member is closed it is not possible for any fuel to flow to the orifice.

A disadvantage with the aforesaid type of nozzle is that even with the type in which the orifice extends from the seating, the orifice is of constant size. As a result during the initial movement of the valve member away from its seating the flow of fuel is throttled by the valve member and this leads to poor atomisation of the fuel. The same effect occurs during closure of the valve member onto its seating.

In order to overcome the problems posed by the presence of the sac and the throttling effect of the seating, it has been proposed to cause the valve member to move in the opposite direction against the action of the resilient loading. The orifice in this case is formed in the portion of the valve member which is exposed beyond the end of the bore when the valve member is in the open position. The orifice is covered by the wall of the bore when the valve member is in the closed position and the orifice is supplied with fuel through a passage which is formed in the valve member. With this arrangement the area of the orifice increases from zero as the valve member moves to the fully open position and as a result superior atomisation of the fuel is obtained during the critical nozzle opening and closing periods. This is because the orifice area is variable and the restriction imposed by the well known orifice square law of pressure/flow does not apply. Large volumes of fuel can therefore be delivered in a given period without the need for high pressures conversely the same volume of fuel can be delivered in a shorter period.

With this form of nozzle the valve member is subjected to tensile stress due to the fuel pressure within the passage. This stress due to the shock wave in the column of fuel from the fuel pump, can be very high and care must be taken in the design of the valve member.

The object of the present invention is to provide a fuel injection nozzle in a simple and convenient form.

According to the invention a fuel injection nozzle of the kind specified comprises a bore extending through the body and connected with said inlet, the bore defining a reduced valve guide portion at its outer end, said valve member being located within said bore and having an outer end portion guided for movement by said valve guide portion, the valve member being loaded by said resilient means in an outward direction and said orifice being formed in the outer end portion of the valve member and having its upstream end positioned to be covered by said valve guide portion of the bore in the closed position of the valve member, said upstream end of the orifice being uncovered to the bore to permit flow of fuel through the orifice as the valve member moves to the open position.

Figure 2:
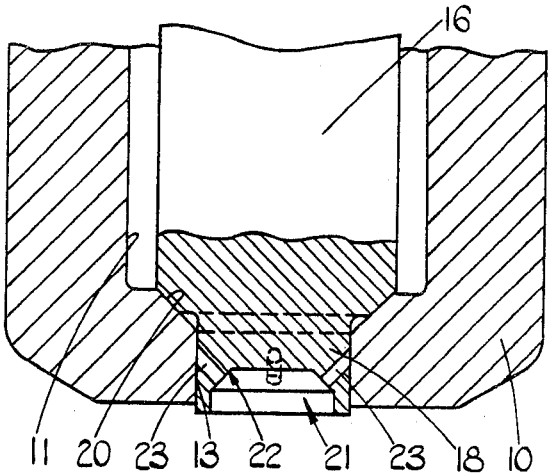
Figure 3:
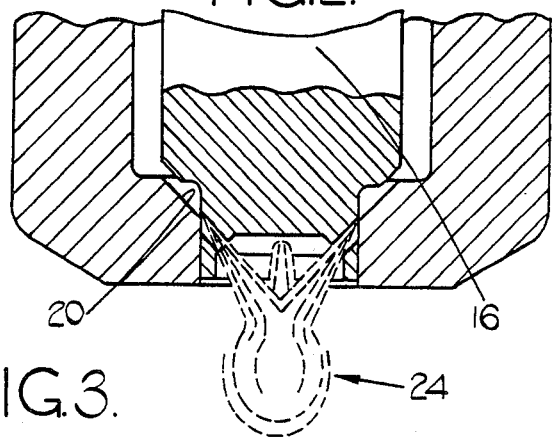
Figure 4:
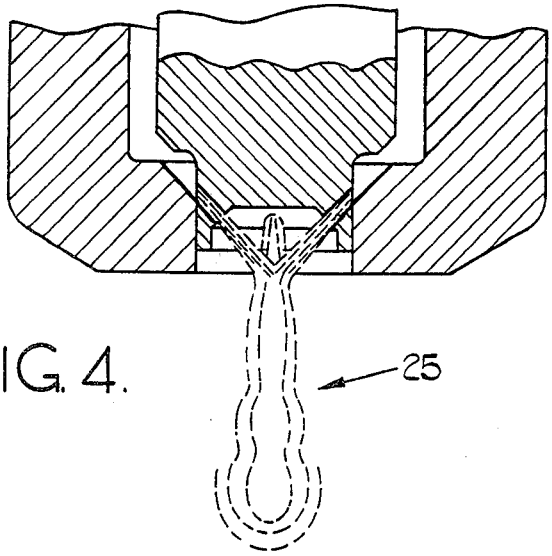
Figure 5:
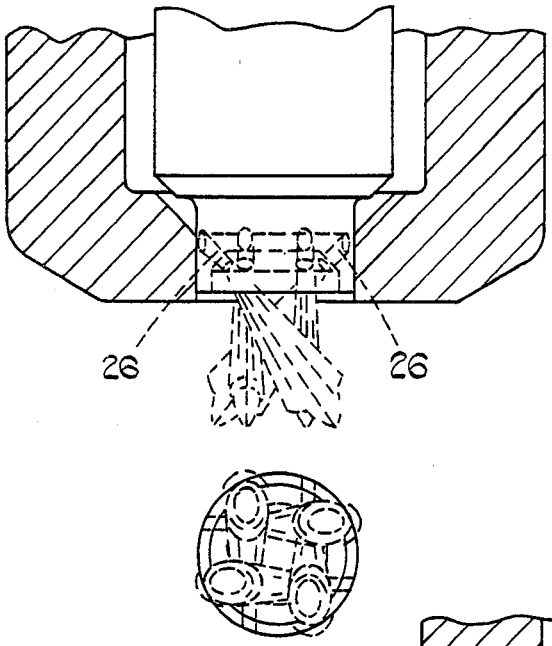
Figure 6:
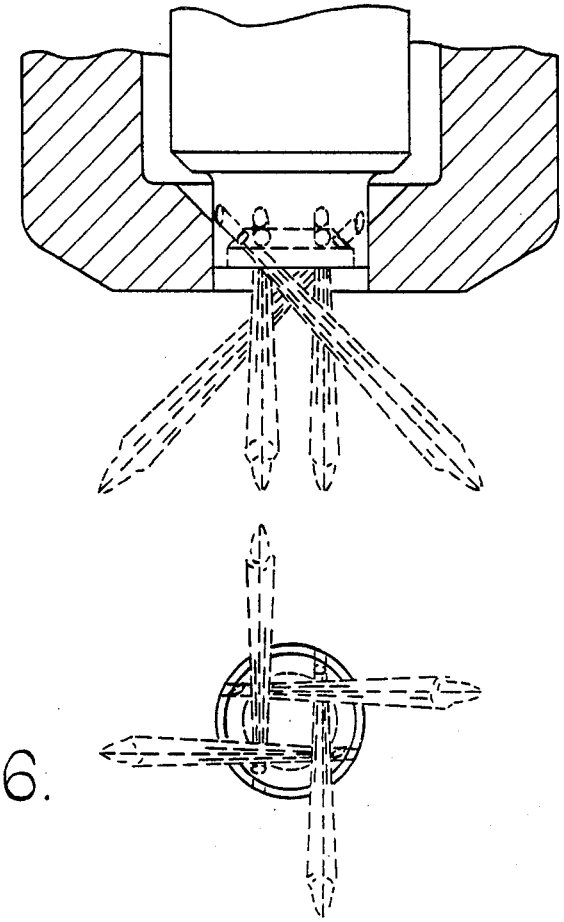
Figure 7:
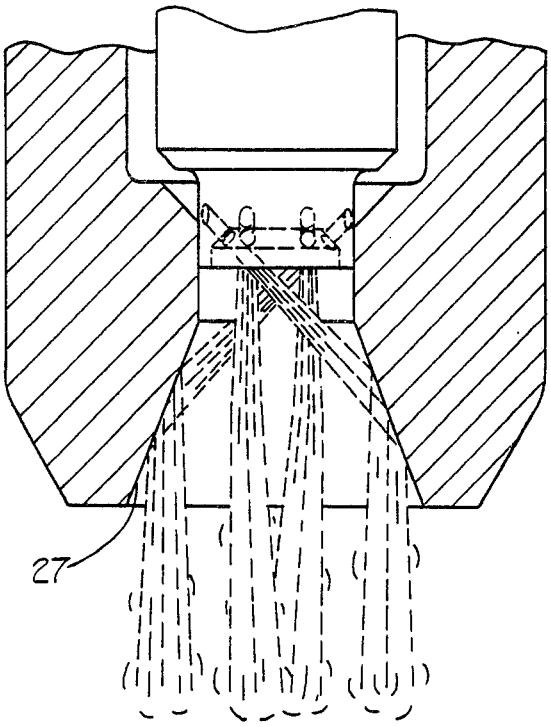
Figure 7:
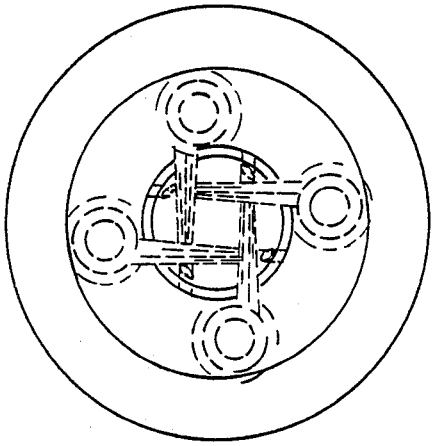

An example of a fuel injection nozzle in accordance with the invention will now be described with reference to the accompanying drawings in which:

FIG. 1 is a sectional side elevation of a nozzle,

FIGS. 2, 3 and 4 are sections to an enlarged scale of part of the nozzle seen in FIG. 1 in the closed position and two open positions, FIGS. 5 and 6 are views similar to FIGS. 3 and 4 showing a modification to the nozzle of FIG. 1, FIG. 7 is a view similar to FIG. 6 showing a further modification and FIG. 8s is a view similar to FIG. 2 showing a further modification thereof.

Referring to FIG. 1 of the drawings, the nozzle comprises a body 10 of stepped cylindrical form which in use, is clamped to a nozzle holder by means of a cap nut which engages the step defined on the body. Formed in the body is an axially extending bore 11 which at one end defines a guide portion 12 and at its other end a further guide portion 13 (FIG. 2) which is smaller in diameter than the main portion of the bore 11. The guide portion 12 is of slightly larger diameter than the main portion of the bore 11 and adjacent the guide portion there is defined an annular chamber 14 which is connected by means of a fuel supply passage 15 to a fuel inlet formed in the nozzle holder, the fuel inlet in use, being connected to the outlet of a high pressure fuel injection pump.

Extending within the bore is a valve member 16. The main portion of the valve member defines an annular clearance with the main portion of the bore 11. The valve member has a portion 17 which is slidably accomodated within the guide portion 12 of the bore and it has an outer end portion 18 (FIG. 2) which is slidably accomodated within the guide portion 13 of the bore.

The valve member has a reduced portion 19 which extends in use into the chamber defined in the nozzle holder and in which is located a coiled compression spring 19A which acts upon the valve member in a direction to urge the valve member outwardly. In the example shown in FIG. 1 the extent of outward movement of the valve member is limited by means of a seating surface 20 (FIG. 2) which is defined between the portion 11 of the bore and the guide portion 13. The valve member 16 is shaped to co-operate with the seating and when this co-operation is established, the valve member is said to be in the closed position. This is the position shown in FIGS. 1 and 2.

Figure 8:
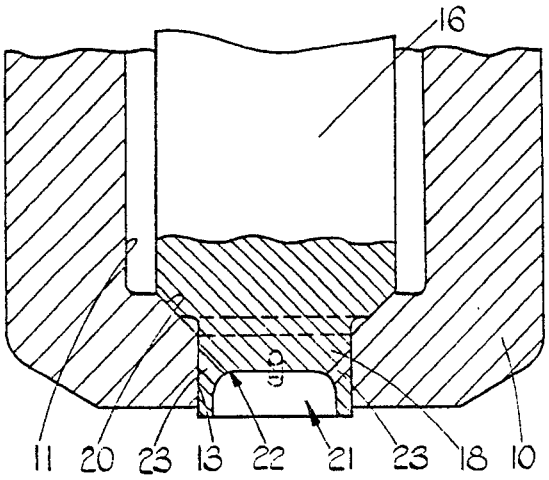

As will be seen from FIGS. 1 and 2 in the closed position the outer end portion 18 projects slightly beyond the body 10 however, this is not absolutely necessary. Formed in the end of the valve member is a recess 21. The recess 21 has a right cylindrical mouth portion and a flat base wall of smaller diameter than the mouth portion and in the example, an inclined connecting surface 22 which may however be of curved form as shown in FIG. 8. Opening onto the connecting surface is a plurality of drillings defining outlet orifices 23 and the upstream ends of these orifices terminate on the surface of the outer end portion 18 of the valve member. The orifices are positioned such that the upstream ends thereof are covered by the surface of the reduced valve guide portion 13 when the valve member is in the closed position. In the example shown in FIGS. 2, 3 and 4 the axes of the orifices meet at a common point on the centre line of the valve member.

When fuel under pressure is supplied through the passage 15, the fuel pressure acts upon the valve member in a direction to move the valve member against the action of the coiled compression spring and in so doing the valve member is lifted from the seating. No flow of fuel through the orifices takes place until the upstream ends of the orifices are exposed to the bore 11. This is shown in FIG. 3 where the upstream ends of the orifices are just exposed and fuel is flowing through the orifices. The jets of fuel impinge on each other to create a spray pattern indicated at 24. The fuel is finely atomised and this is ideal for engine idling and also the start of injection. Moreover, it is possible that an engine fitted with this form of nozzle will not require excess of fuel for starting purposes. As the valve member moves further away from its seating, the area of the orifices exposed to the bore 11 increases and a more penetrating jet of fuel flows through each orifice. As a result the spray pattern assumes a different shape changing from the generally spherical pattern shown at 24 in FIG. 3 to an elongated pattern shown at 25 in FIG. 4. The pressure drop across the orifices remains substantially constant and this is the great advantage of this type of injection nozzle. Moreover, the orifices 23 when the valve member is in the closed position, are well recessed so that it can be expected that the valve member and in particular the outer end portion 18 thereof will not attain such a high temperature as in the case of an outwardly opening valve member in which the orifices are formed in the valve member and fed by means of a passage within the valve member.

It is possible to eliminate the seating but if this is done some other arrangement must be provided for limiting the outward movement of the valve member under the action of the spring. Moreover, it is felt that when the valve member moves onto the seating at the end of the delivery of fuel by the associated injection pump, the shock tends to shake away any fuel remaining in the orifices 23 so that the risk of the orifices becoming blocked by carbonised fuel is minimised.

In the arrangement shown in FIGS. 5 and 6 the axes of the orifices 26 do not meet the axis of the valve member at a common point. As will be seen from the end views shown in FIGS. 5 and 6 the orifices are so disposed that the jets of fuel issuing therefrom do not impinge. As a result four jets of fuel issue from the nozzle. FIG. 5 shows the form of jet when the orifices 26 are just starting to open whereas FIG. 6 shows the form of the jets of fuel when the valve member is in the fully open position. As with the example shown in FIGS. 1–4, the ability of the jets to penetrate increases as the valve member moves towards the fully open position.

In the arrangement shown in FIG. 7, the jets of fuel are allowed to impinge upon a surface 27 defined on the valve body. For this purpose the valve body is of increased thickness but otherwise the construction of the nozzle is the same as the earlier examples. In FIG. 7 the surface 27 is of truncated conical form if desired however a portion of the valve body can be cut away so that at least one and possibly two of the jets does not impinge upon the body.

It is possible to form the orifices 23 as serrations or slots in the end surface of the reduced portion of the valve member. The slots are positioned so that they are progressively uncovered as the valve member moves away from the seating.

With the nozzles described the valve member is subjected to compressive stress in the region of the orifices or slots due to the action of the fuel under pressure. The body 10 is of course subject to tensile stress but this can be designed to withstand this stress. Moreover, the fact that the valve member is recessed means that the risk of damage during handling is minimised.

It will be appreciated that the spray pattern of the nozzles shown in FIGS 2–4 can be modified by arranging that one or more of the jets does not impinge on the other jets.

We claim:

1. A fuel injection nozzle for use with an internal combustion engine comprising a body having a fuel inlet which in use, is connected to a high pressure source of fuel, a resiliently loaded valve member slidable within the body, said valve member defining a surface against which the fuel under pressure can act to lift the valve member to an open position against the resilient loading to allow fuel flow to an outlet orifice, a bore extending through the body and connected with said inlet, the bore defining a reduced valve guide portion at its outer end, said valve member being located within said bore and having an outer end portion guided for movement by said valve guide portion, the valve member being loaded by said resilient means in an outward direction and said orifice being formed in the outer end portion of the valve member characterized in that the orifice comprises a single drilling the downstream end of which opens onto the exterior surface of said outer end portion of the valve member, the upstream end of the drilling being positioned to be covered by said valve guide portion of the bore in the closed position of the valve member, said upstream end of the drilling being progressively uncovered to the bore to permit flow of fuel through the orifice as the valve member moves to the open position.

2. A nozzle according to claim 1 including a seating formed in the bore adjacent said valve guide portion, said valve member being shaped for cooperation with said seating, and said valve member being lifted from the seating before the upstream end of the drilling is uncovered.

3. A nozzle according to claim 2 in which said bore defines a further valve guide portion of larger diameter than the first mentioned valve guide portion, said valve member having a portion for co-operation with said further guide portion.

4. A nozzle according to claim 1 or claim 2 including a recess defined in the outer end portion of the valve member, said orifice opening into said recess.

5. A nozzle according to claim 4 in which said recess has a right cylindrical mouth portion, a flat base wall and a connecting surface, said orifice opening onto said connecting surface.

6. A nozzle according to claim 5 in which said connecting surface is inclined.

7. A nozzle according to claim 5 in which said connecting surface is curved.

8. A nozzle according to claim 5 including a plurality of said orifices.

9. A nozzle according to claim 8 in which the axes of said orifices are so disposed that at least one of the jets of fuel issuing from said orifices impinges upon each other.

10. A nozzle according to claim 8 in which at least one of said orifices is disposed so that the jet of fuel issuing therethrough impinges upon a surface of the body.

* * * * *